US006765602B2

(12) United States Patent
Mori

(10) Patent No.: US 6,765,602 B2
(45) Date of Patent: Jul. 20, 2004

(54) THERMAL PRINTER HAVING A REDUCED SIZE

(75) Inventor: Yukihiro Mori, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/463,513

(22) Filed: Jun. 18, 2003

(65) Prior Publication Data

US 2004/0119808 A1 Jun. 24, 2004

(30) Foreign Application Priority Data

Dec. 18, 2002 (JP) ..... 2002-367091

(51) Int. Cl.[7] ..... B41J 25/304
(52) U.S. Cl. ..... 347/220
(58) Field of Search ..... 347/197, 198; 400/120.16, 120.17

(56) References Cited

U.S. PATENT DOCUMENTS 6,249,302 B1 * 6/2001 Sekiya ..... 347/220
6,450,714 B2 * 9/2002 Mori et al. ..... 400/649
6,567,113 B2 * 5/2003 Louis ..... 347/222

FOREIGN PATENT DOCUMENTS

JP 11-151847 * 6/1999 ..... B41J/25/312
JP 2000-318260 11/2000

* cited by examiner

*Primary Examiner*—Huan Tran
(74) *Attorney, Agent, or Firm*—Staas & Halsey LLP

(57) ABSTRACT

A thermal printer including a thermal head, a platen roller, a frame having platen roller receiving parts that receive the platen roller in a detachable manner, is disclosed. The thermal head is fixed to a thermal head supporting member that is operatively coupled to the frame. The thermal head supporting member includes platen roller lock parts that lock the platen roller received by the platen roller receiving part so as to resist or prevent the platen roller from exiting the platen roller receiving part.

7 Claims, 14 Drawing Sheets

THERMAL PRINTER HAVING A REDUCED SIZE

BACKGROUND OF THE INVENTION

1. Field of the Invention

The present invention generally relates to thermal printers and apparatuses having a thermal printer, and more particularly, to a thermal printer in which a platen roller is detachable from a frame.

2. Description of the Related Art

Regarding thermal printers mounted in hand-held devices and POS terminals, a clamshell type that allows easy setting of a paper roll is becoming the mainstream. In the clamshell type, when a cover is rotated and closed, a platen roller is pressed against a thermal head via paper and is fit and fixed to a frame. Thus, it is necessary to provide a lock mechanism so that the fixed platen roller not be easily separated from the frame.

FIG. 1 shows a thermal printer 10 of a conventional clamshell type. In FIG. 1, the thermal printer 10 includes a frame 11, a platen roller 12, a thermal head 13, a paper roll 14, paper 15 (a part of the paper roll 14), a lock arm 16, a cam 17, an operation lever 18, and a spring 19.

The platen roller 12 is moved downward from above, and pressed against the thermal head 13 via the paper 15. On this occasion, a shaft 12*a* of the platen roller 12 provided at an end of the platen roller 12 is fit into a U-shaped slot 11*a* of the frame 11 and locked by the lock arm 16.

For setting a new paper roll 14, an operator operates the operation lever 18 so as to rotate the cam 17 and rotate the lock arm 16 for a little in the clockwise direction. Consequently, the lock of the shaft 12*a* is released (for example, refer to Japanese Laid-Open Patent Application No. 2000-318260, paragraph No. 0015, FIG. 2).

The thermal printer 10 shown in FIG. 1 is additionally provided with three dedicated components, that is, the lock arm 16, the cam 17, and the operation lever 18, in order to lock and release the platen roller 12. Thus, there is a problem in that the increase in the number of components increases the manufacturing cost, the assembly processes, and the size and weight of the thermal printer.

SUMMARY OF THE INVENTION

It is a general object of the present invention to provide an improved and useful thermal printer, and an apparatus having the thermal printer, in which the above-mentioned problems are eliminated.

In order to achieve the above-mentioned object, according to one aspect of the present invention, there is provided a thermal printer that includes:

a thermal head;

a platen roller;

a frame having platen roller receiving parts that receive the platen roller in a detachable manner; and a thermal head supporting member to which the thermal head is fixed, the thermal head supporting member being operatively coupled to the frame, the thermal head supporting member including platen roller lock parts that lock the platen roller received by the platen roller receiving parts so as to resist or prevent the platen roller from exiting the platen roller receiving part.

Accordingly, components dedicated to locking the platen roller are not required, which is advantageous for reducing the size of a thermal printer. Moreover, since the number of assembly processes is decreased, it is possible to reduce manufacturing costs.

Also, in a thermal printer, the thermal head supporting member may include platen roller lifting parts that move the platen roller in the direction in which the platen roller exits the platen roller receiving parts when the thermal head is moved in the direction in which the thermal head is separated from the platen roller.

Accordingly, components dedicated to lifting (pushing up) the platen roller in the direction in which the platen roller exits the platen roller receiving parts are not required, which is advantageous for reducing the size of a thermal printer. Moreover, the number of assembly processes is decreased. Thus, it is possible to reduce manufacturing costs.

In addition, in a thermal printer, the thermal head supporting member may include an operation part that displaces the thermal head in a direction in which the thermal head is separated from the platen roller.

Accordingly, it is possible to simplify the construction of a part operated so as to displace the thermal head supporting member.

Further, the thermal head supporting member may include a head pressure biasing spring portion that biases head pressure whereby the thermal head presses the platen roller.

Accordingly, head pressure biasing spring members are not required, which is advantageous for reducing the size of a thermal printer. Moreover, the number of assembly processes is decreased. Thus, it is possible to reduce manufacturing costs Additionally, a thermal printer may further include:

a head pressure biasing spring member for pressing the thermal head supporting member so as to bias head pressure whereby the thermal head presses the platen roller, and the head pressure biasing spring member may include a spring portion that is pressed and deflected by the platen roller received in the platen roller receiving parts, and when the lock of the platen roller is released, restored so as to move the platen roller in the direction in which the platen roller exits the platen roller receiving part.

Accordingly, it is possible to realize, with a small number of components, a thermal printer in which the platen roller pops up when the lock of the platen roller is released.

Furthermore, according to another aspect of the present invention, there is provided an apparatus that includes:

a thermal printer including:

a thermal head;

a platen roller;

a cover supporting the platen roller, the cover being rotatably opened and closed;

a frame having platen roller receiving parts that receive the platen roller in a detachable manner, the platen roller being received by the platen roller receiving parts when the cover is closed; and a thermal head supporting member to which the thermal head is fixed, the thermal head supporting member being operatively coupled to the frame, the thermal head supporting member including platen roller lock parts that lock the platen roller received by the platen roller receiving part so as to resist or prevent the platen roller from exiting the platen roller receiving part.

Accordingly, since the size of the thermal printer is reduced, the size of the apparatus is also reduced.

Other objects, features and advantages of the present invention will become more apparent from the following detailed description when read in conjunction with the drawings.

DETAILED DESCRIPTION OF THE PREFERRED EMBODIMENTS

Figure 1:
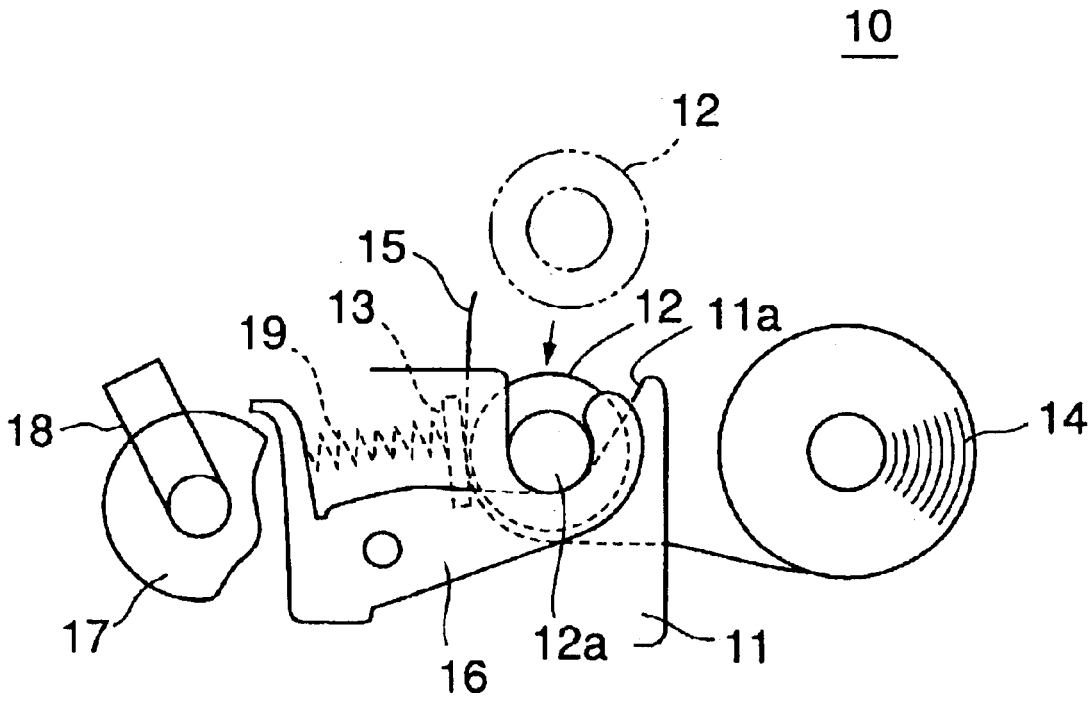
FIG.1 PRIOR ART
FIG. 1 is a schematic side view showing a conventional thermal printer.
Figure 2:
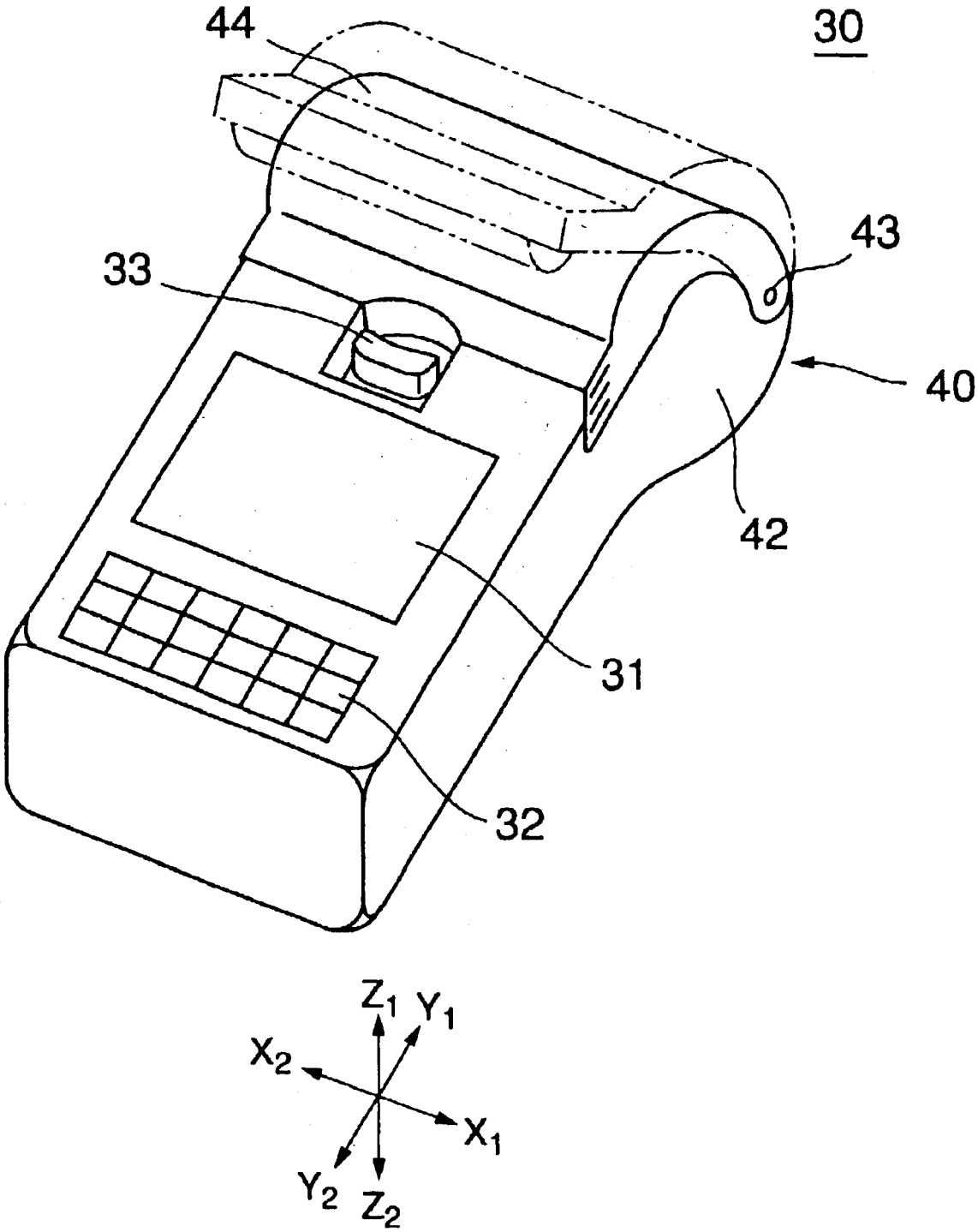
FIG. 2 is a perspective view showing a hand-held device according to one embodiment of the present invention.

FIG. 2 shows a hand-held device 30 according to one embodiment of the present invention. In FIG. 2, X1–X2 indicates the width direction, Y1–Y2 indicates the longitudinal direction, and Z1–Z2 indicates the height direction. The hand-held device 30 is provided with a line thermal printer 40 of a clamshell type on Y1 side and includes a liquid crystal display part 31, key switches 32, and an operation knob 33 at the top surface.

Figure 3A:
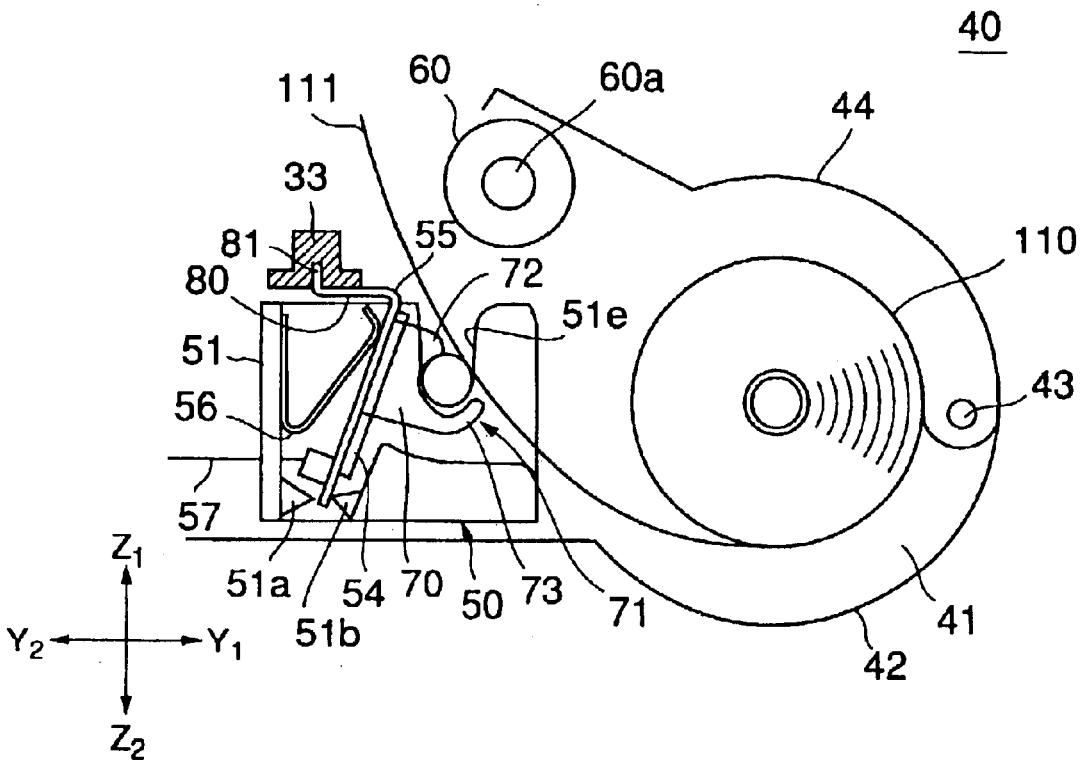
FIGS. 3A and 3B are side views showing the operation of closing a cover of a clamshell type thermal printer.
Figure 3B:
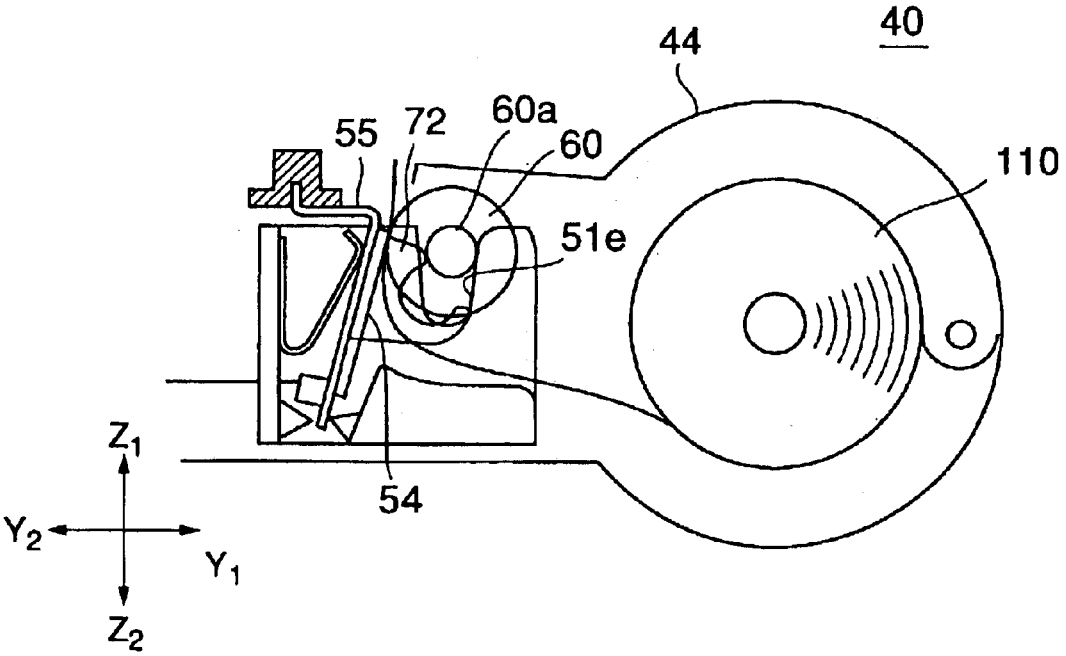
Figure 4A:
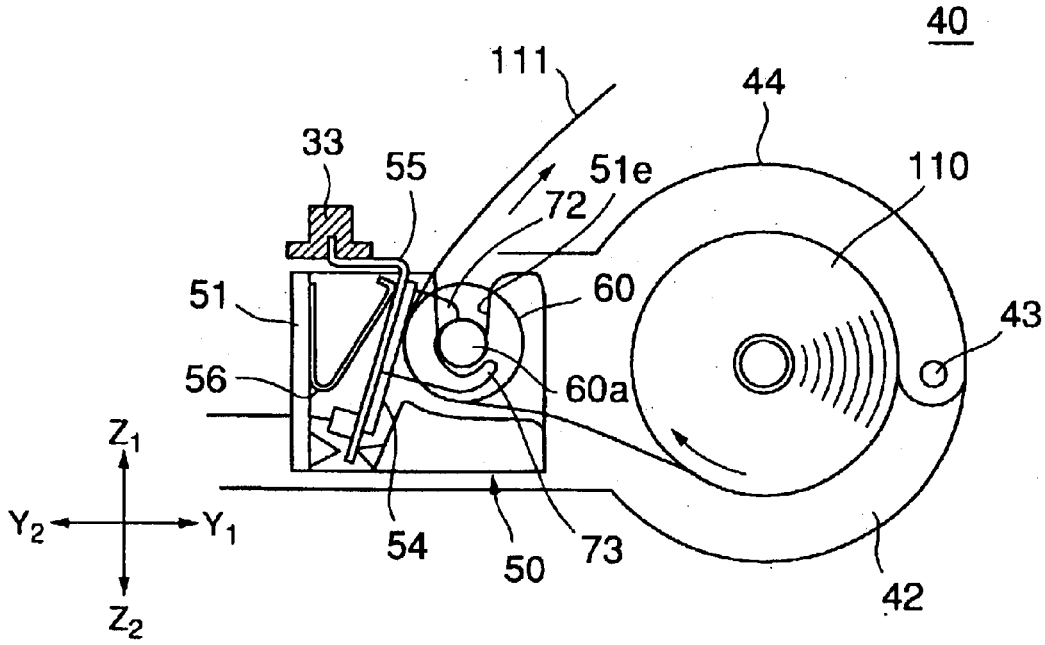
FIGS. 4A and 4B are side views showing the operation of opening the cover of the clamshell type thermal printer.
Figure 4B:
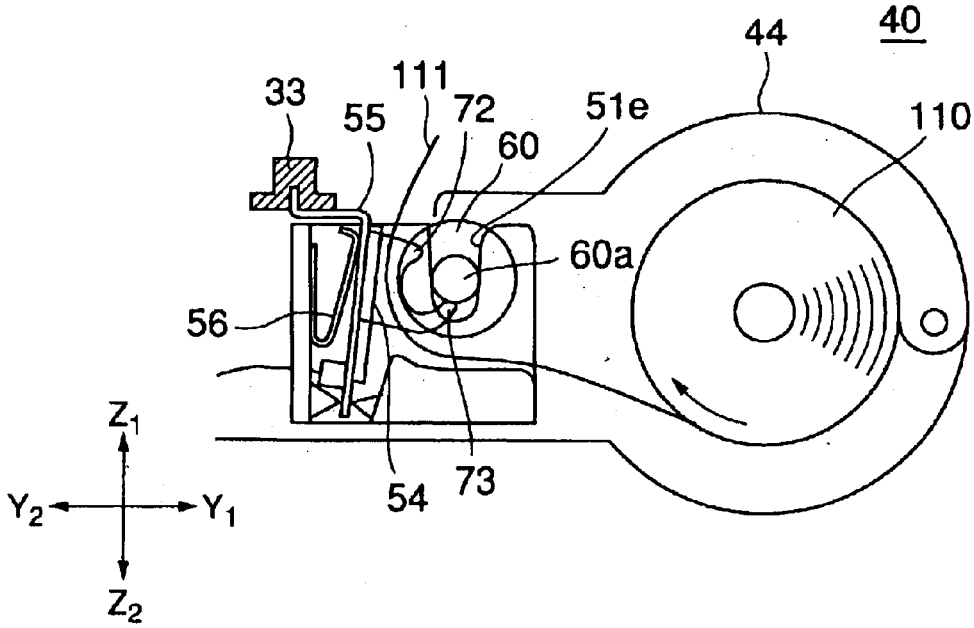

FIGS. 3A and 3B show a closing operation of the clamshell type thermal printer 40, and FIGS. 4A and 4B show an opening operation of the clamshell type thermal printer 40. As shown in FIG. 3A, the clamshell type thermal printer 40 is formed by a case 42, a cover 44 that can be opened/closed and is supported by the case 42 via a shaft 43 at one end, and a thermal printer unit 50 (shown in greater detail in FIG. 5) fixed to the case 42. A paper roll holding part 41 holding a paper roll is formed in the case 42. The cover 44 covers the paper roll holding part 41. A platen roller 60 is supported at the head of the cover 44.

Figure 5:
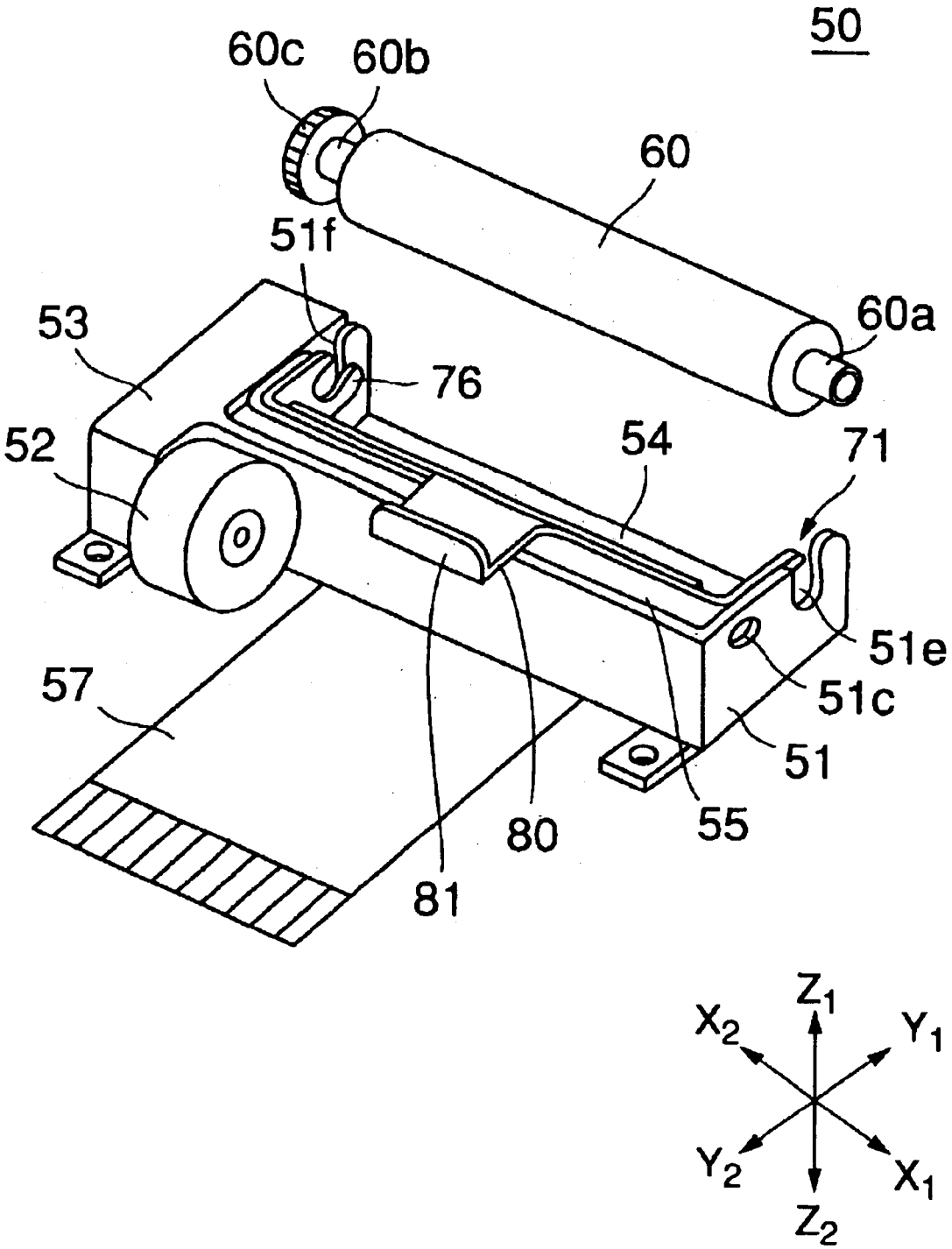
FIG. 5 is a perspective view showing a thermal printer unit.
Figure 6A:
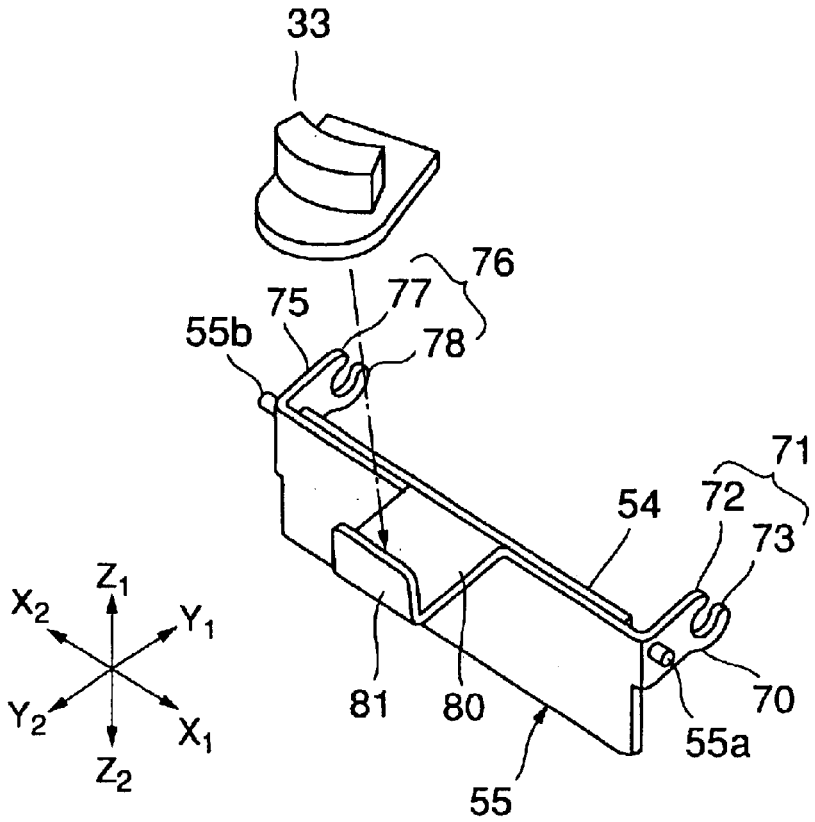
FIGS. 6A and 6B are perspective views showing a thermal head supporting member.
Figure 6B:
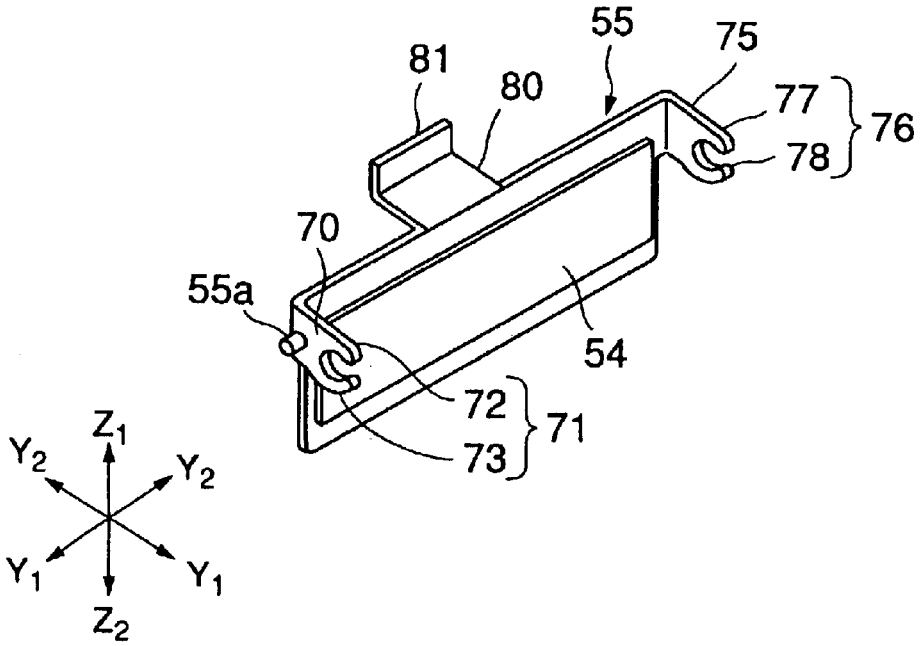

As is shown in FIG. 5, in the thermal printer unit 50, a motor 52 and a gear box 53 are fixed to a frame 51. Moreover, a thermal head supporting member 55 to which a thermal head 54 shown in FIGS. 6A and 6B is fixed, and a head pressure biasing spring member (hereinafter referred to as a "spring member") 56 that is a leaf spring are operatively coupled to the frame 51 of the thermal printer unit 50, for example, in the manner illustrated in FIG. 5. Further, a flexible print cable 57 extends from the thermal head 54, and a platen roller 60 is fixed to the frame 51 in a detachable manner. The thermal head supporting member 55 serves to support the thermal head 54 and serves as a heat sink that diffuses heat generated in the thermal head 54. It should be noted that the present invention includes the thermal printer unit 50.

As is shown in FIG. 3A, the lower side of the thermal head supporting member 55 is interposed between and supported by pivots 51*a* and 51*b*. Pin parts 55*a* and 55*b* shown in FIG. 6A, provided on both upper sides of the thermal head supporting member 55, are fit to slots 51*c* and 51*d* (only one of which is shown). The spring member 56 forms a V-shape, is mounted between the thermal head supporting member 55 and the frame 51, and presses the thermal head 54 against the platen roller 60.

The platen roller 60 includes shaft parts 60*a* and 60*b* at its opposite ends and includes a gear 60*c* on one end. The platen roller 60 is supported by the frame 51 such that the shaft parts 60*a* and 60*b* are fit to respective platen roller receiving parts 51*e* and 51*f* of the frame 51, the receiving parts 51*e* and 51*f* each being formed into a U-shape slot. The gear 60*c* is engaged with an output gear (not shown) of the gear box 53.

In accordance with the present invention, the thermal head supporting member 55 can be pivoted, as illustrated, over a predetermined range of angles with respect to the frame 51 via the pin parts 55*a* and 55*b* sliding within the corresponding slots 51*c* and 51*d*, and a bottom portion of the thermal head supporting member 55 being guided by the pivots 51*a* and 51*b*. The thermal head supporting member 55 is formed by performing press work on a metal plate. The thermal head supporting member 55 includes arm parts 70 and 75 extending in the direction indicated by Y1 (hereinafter referred to as the "Y1 direction") at both ends and also includes an arm part 80 in the middle as an operation part extending in the Y2 direction. As shown in FIG. 3A, the operation knob 33 is fit to a rising part 81 at an end of the arm part 80. Bifurcate portions 71 and 76 are provided at the tips of the arm parts 70 and 75, respectively. The bifurcate portion 71 includes an upper platen roller lock part (hereinafter referred to as a "lock part") 72 and a lower platen roller lifting part (hereinafter referred to as a "lifting part") 73. The bifurcate portion 76 includes an upper platen roller lock part (hereinafter referred to as a "lock part") 77 and a lower platen roller lifting part 78. The lock part 72 and the lifting part 73 are located at the position corresponding to the platen roller receiving part 51*e*. The platen roller lock part 77 and the platen roller lifting part 78 are located at the position corresponding to the platen roller receiving part 51*f*.

In the description that follows, the operation of the thermal printer is described with reference to the X1 portion of the thermal printer (for example, the shaft part 60*a*, the bifurcate portion 71, and the platen roller receiving part 51*e*). For sake of brevity, the description relating to the X2 portion (for example, the shaft part 60*b*, the bifurcate portion 76, and the platen roller receiving part 51*f*) is omitted.

Figure 7:
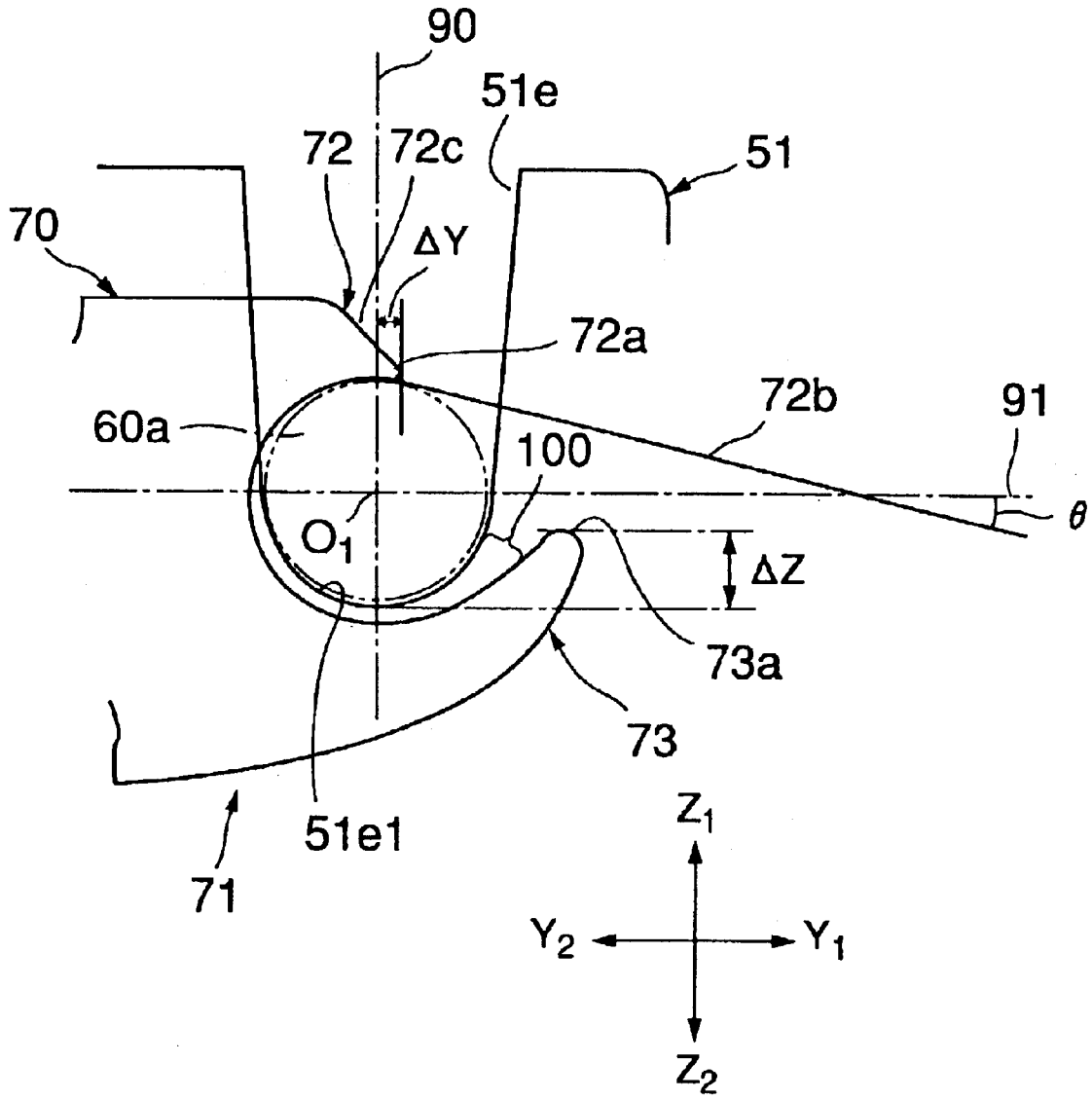
FIG. 7 is a side view showing the shapes of a lock part and a lifting part in an enlarged manner.

FIG. 7 shows the shapes of the lock part 72 and the lifting part 73 in an enlarged manner, in conjunction with the shaft part 60*a* and the platen roller receiving part 51*e*.

The platen roller receiving part 51*e* includes an arcuate bottom portion 51*e*1 having a point O1 as the center. The reference numeral 90 designates the center line of the platen roller receiving part 51*e*, which center line is drawn through the point O1 and extends in the directions indicated by Z1–Z2. The reference numeral 91 designates a line drawn through the point O1 and orthogonal to the center line 90. The line 91 extends in the directions indicated by Y1–Y2. In FIG. 7, the two-dot chain line indicates the shaft part 60*a* assuming that the platen roller 60 is mounted.

The lock part 72 extends into the platen roller receiving part 51*e* in the Y1 direction at a position above the shaft part 60*a*. That is, the lock part 72 extends alongside the platen roller receiving part 51*e* and into a X1–X2 projecting path of the platen roller receiving part 51*e*. A tip 72*a* of the lock part 72 is displaced in the Y1 direction relative to the center line 90 by a distance ΔY. A tangent line 72*b* is declined downward to the right, that is, declined in the direction indicated by Z2 (hereinafter referred to as the "Z2 direction") as the tangent line 72*b* extends in the Y1 direction. The tangent line 72*b* intersects the line 91 at an angle θ. The upper surface of the lock part 72 is referred to herein as an inclined surface 72*c*.

The lifting part 73 extends in the Y1 direction to form an upward sloping arc-like shape that is lower in the Z2 direction than the platen roller receiving part 51*e*. A tip 73*a* of the lifting part 73 is located farther in the Y1 direction than the platen roller receiving part 51*e*. Moreover, the tip 73*a* of the lifting part 73 is displaced in the direction indicated by Z1 (hereinafter referred to as the "Z1 direction") relative to the lowermost portion of the bottom portion 51*e*1 of the platen roller receiving part 51*e* by a distance Δz. A spacing 100 in the directions indicated by Y1–Y2 exists between the lifting part 73 and the platen roller receiving part 51*e*. The spacing 100 enables lock release and lifting (pushing up)(that are described below) to be performed with desired timing.

Next, a description will be given of the opening and closing operations of the cover 44 of the clamshell type thermal printer 40, and the operations of the bifurcate portions 71 and 76 then.

The paper roll 110 is set inside the paper roll holding part 41, and the cover 44 is pivoted to be closed with the paper 111 pulled out. The cover 44 is rotated from the state shown in FIG. 3A to a substantially closed position as shown in FIG. 3B as an initial stage in which the shaft part 60*a* of the platen roller 60 enters the platen roller receiving part 51*e* from the Z1 side, and contacts and is supported by the upper surface of the lock part 71. In this state, the operator manually presses the cover 44. With this operation, the cover 44 is pivoted to a final position shown in FIG. 4A, at which the cover 44 is completely closed, and locked by the lock part 71 at the position then as a final stage. On this occasion, the spring member 56 causes the thermal head 54 and the platen roller 60 to press towards each other with the paper 111 interposed therebetween. In addition, in a last stage of the pivot of the cover 44, the spring member 56 is temporarily elastically deformed as shown in FIG. 4B, and the thermal head supporting member 55 is rotated in the counterclockwise direction.

Figure 8A:
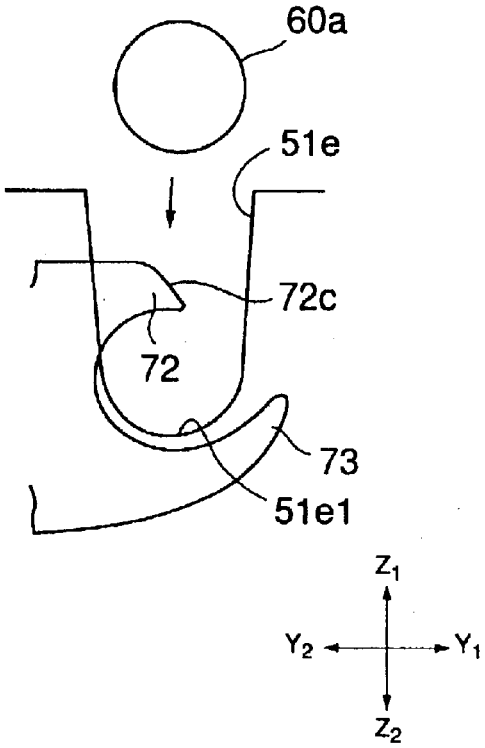
FIGS. 8A, 8B, 8C, and 8D are side views showing an operation in which a platen roller is locked when closing the cover.
Figure 8B:
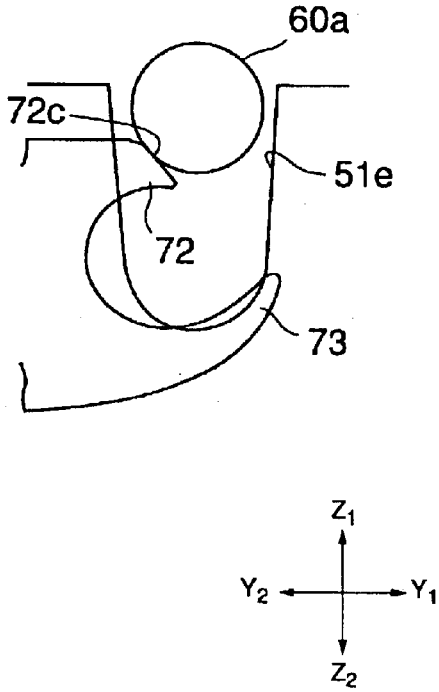
Figure 8C:
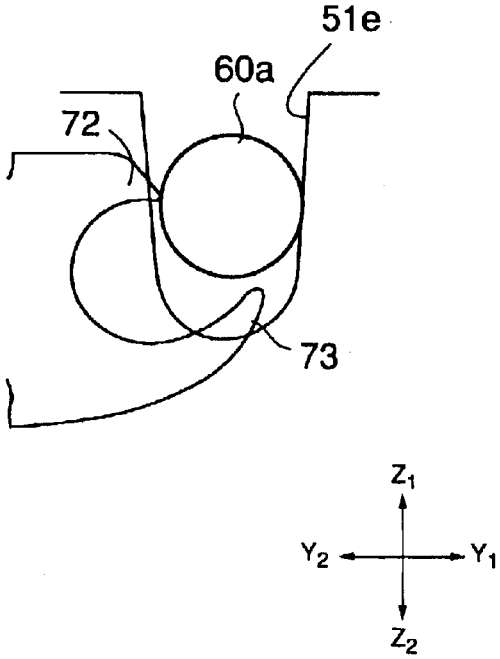
Figure 8D:
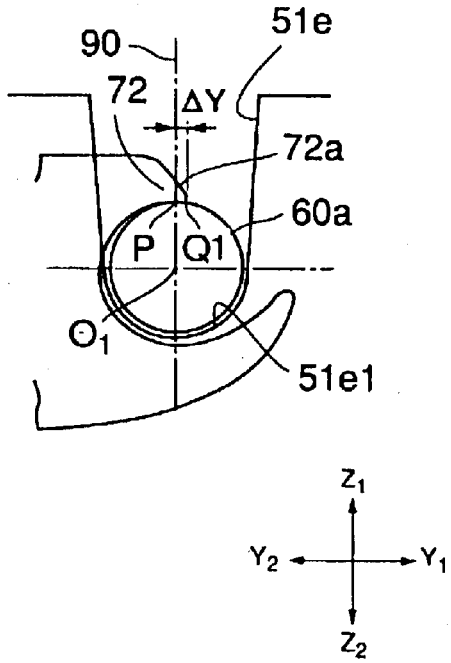

FIGS. 8A through 8D show the operation of the bifurcate portion 71 then in an enlarged manner. As is shown in FIG. 8A, the shaft part 60*a* of the platen roller 60 enters, from the Z1 side, the platen roller receiving part 51*e*. Then, as shown in FIG. 8B, the shaft part 60*a* contacts the inclined surface 72*c* of the lock part 72 and urges the lock part 72 in the direction indicated by Y2 (hereinafter referred to as the "Y2 direction"). Thereafter, as shown in FIG. 8C, the shaft part 60*a* makes the lock part 72 retract from the platen roller receiving part 51*e*. The shaft part 60*a* slides by the lock part 72 and reaches the bottom portion 51*e*1 as shown in FIG. 8D.

After the shaft part 60*a* slides by the lock part 72, the bifurcate portion 71 is displaced in the Y1 direction by the spring force of the spring member 56, and as shown in FIG. 8D, the lock part 72 comes above the shaft part 60*a* and locks the shaft part 60*a*. That is, the lock part 72 restricts the shaft part 60*a* from being displaced in the Z1 direction and locks the shaft part 60*a* with respect to the bottom portion 51*e*1 of the platen roller receiving part 51*e*. Similarly, the bifurcate portion 76, which is on the other side, locks the shaft part 60*b*.

Here, the tip 72*a* of the lock part 72 locks the shaft part 60*a* at a position Q1 that is displaced from the peak P in the Y1 direction. Thus, even if a force in the Z1 direction, urging the shaft part 60*a* to exit from the platen roller receiving part 51*e*, is exerted due to dropping impact, for example, a component force in the Y2 direction is not generated in the lock part 72. That is, the lock part 72 fully locks the shaft part 60*a*.

Hence, the platen roller 60 is locked such that the shaft parts 60*a* and 60*b* on both ends are locked by the lock parts 72 and 77, respectively. Thus, even if the hand-held device 30 is erroneously dropped, for example, the cover 44 is not opened.

In addition, since the lock part 72 is temporarily retracted by the shaft part 60*a*, the thermal head 54 is temporarily separated from the platen roller 60, and then contacts the platen roller 60. However, since the platen roller 60 is made of rubber, the impact then is small and insignificant.

When the paper roll 110 is used up and a new paper roll 110 needs to be set, the operator pulls the operation knob 33 in the Y2 direction in the state shown in FIG. 4A. With this operation, as shown in FIG. 4B, the thermal head supporting member 55 is translated in the counterclockwise direction, that is, in the direction in which the thermal head supporting member 55 becomes substantially perpendicular. Thus, the lock of the shaft part 60*a* is released and the cover 44 can be opened. Moreover, the shaft part 60*a* is lifted (pushed up) by the lifting part 73, and the cover 44 is lifted a relatively small amount. In this state, the operator manually opens the cover 44.

Figure 9A:
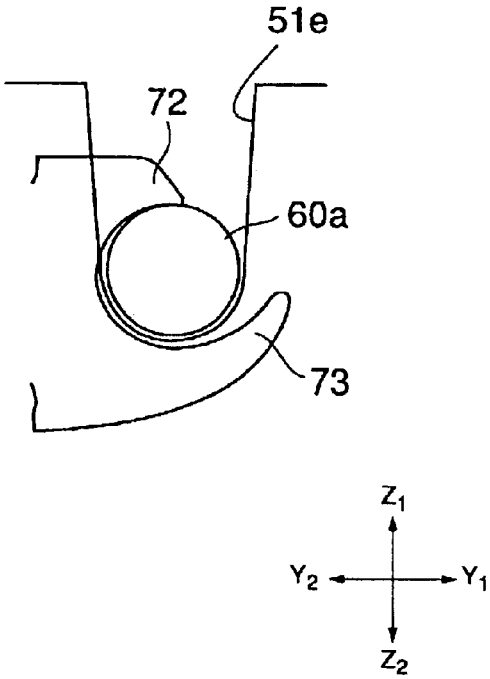
FIGS. 9A, 9B, 9C, and 9D are side views showing the operation in which a lock of the platen roller is released and the platen roller is lifted.
Figure 9B:
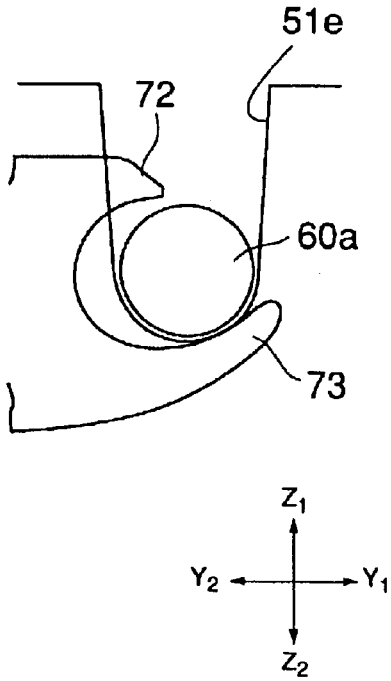
Figure 9C:
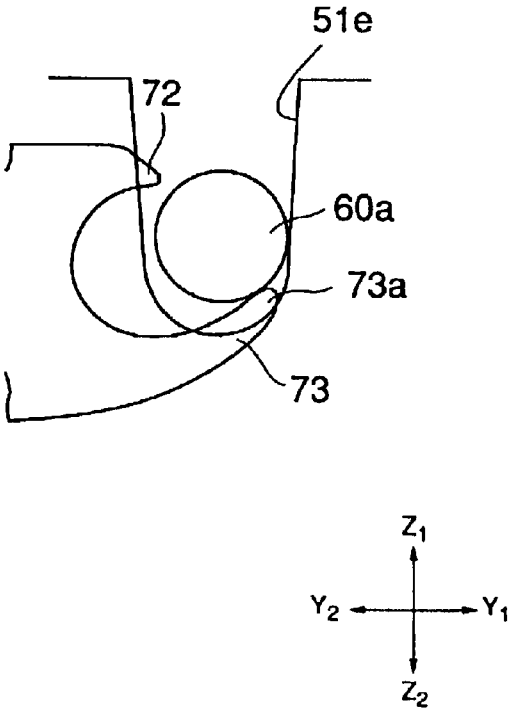
Figure 9D:
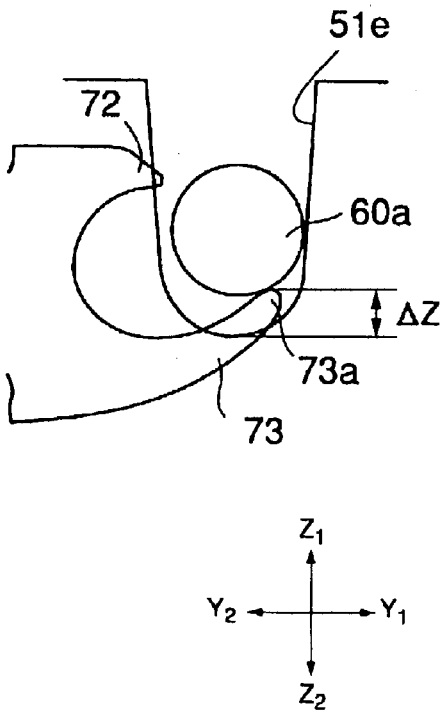

FIGS. 9A through 9D show the operation then of the bifurcate portion 71 in an enlarged manner. The bifurcate portion 71 is moved substantially in the Y1 direction from the state shown in FIG. 9A. As shown in FIGS. 9B and 9C, on one hand, the lock part 72 is displaced such that the lock part 72 exits from the platen roller receiving part 51*e* in the Y2 direction, and thus the lock of the shaft part 60*a* is gradually released. On the other hand, the lifting part 73 is displaced in the Y2 direction, enters the platen roller receiving part 51*e*, and contacts and lifts the lower portion of the shaft part 60*a*. Finally, as shown in FIG. 9D, the lock part 72 exits from the platen roller receiving part 51*e* and the lock of the shaft part 60*a* is released. Moreover, the tip 73*a* of the lifting part 73 lifts the shaft part 60*a* for ΔZ.

As described above, the lock parts 72 and 77, and the lifting parts 73 and 78 are parts of the thermal head supporting member 55. Thus, components dedicated to locking of the platen roller 60 are not used. Accordingly, compared with conventional printers, it is possible to manufacture the thermal printer 40 with a smaller size and less weight without increasing the number of components, thus, with less assembly processes and at lower manufacturing cost.

It should be noted that the thermal printer 40 may be applied to not only the hand-held device 30, but also stationary apparatuses.

Next, a description will be given of variations of the thermal head supporting member 55.

Figure 10A:
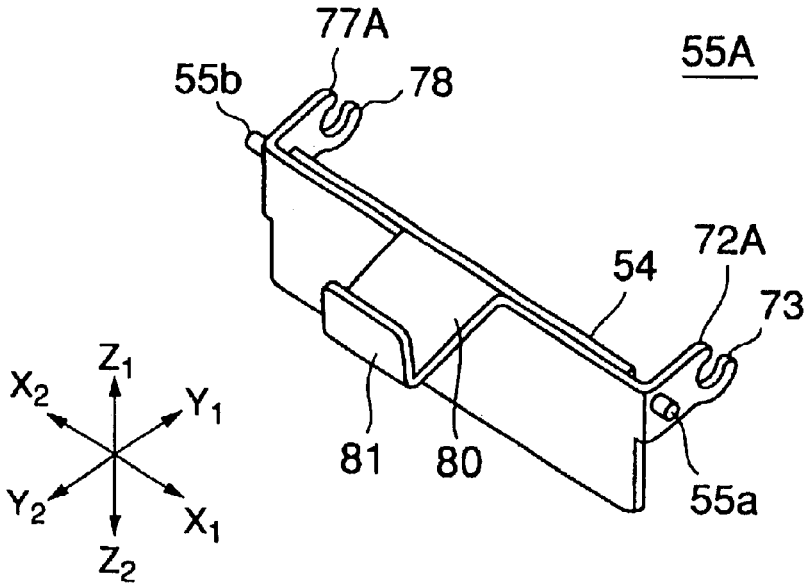
FIGS. 10A and 10B are a perspective view and a side view, respectively, showing a first variation of the thermal head supporting member.
Figure 10B:
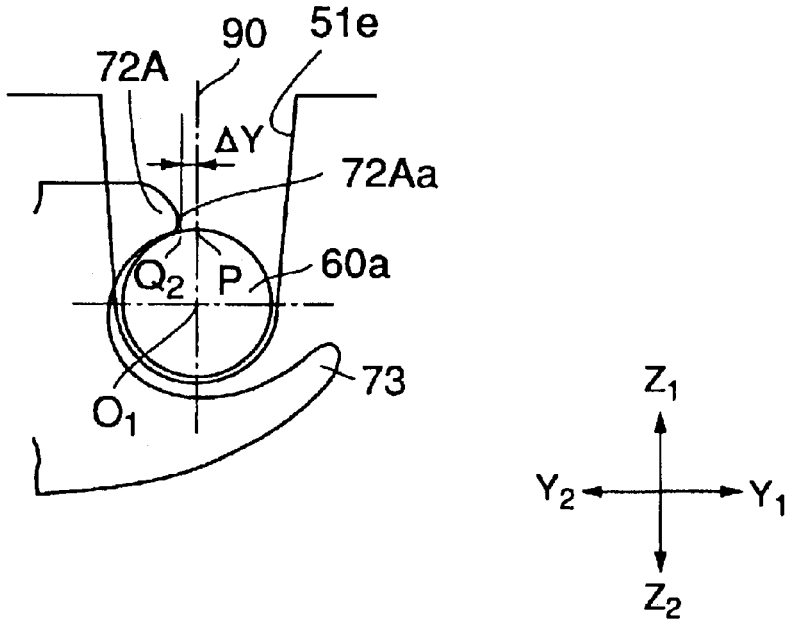

FIGS. 10A and 10B show a thermal head supporting member 55A according to a first variation of the thermal head supporting member 55.

The thermal head supporting member 55A differs from the thermal head supporting member 55 shown in FIGS. 6A, 6B, and 7 in lock parts 72A and 77A. The lock parts 72A and 77A are shorter than the lock parts 72 and 77. As shown in FIG. 10B, the tip 72Aa of the lock part 72A locks the shaft part 60*a* at a position Q2 that is displaced from the peak P in the Y2 direction by a distance ΔY. In other words, the lock part 72A locks the shaft part 60*a* in a state where a component force in the Y2 direction is generated in the lock part 72A if a force in the Z1 direction is exerted on the platen roller 60. The lock part 77A thereby locks the shaft part 60*a* in a similar manner.

When a strong force is exerted on the platen roller 60 in the Z1 direction, the shaft part 60*a* pushes away the lock part 72A in the Y2 direction and is separated from the platen roller receiving part 51*e*. That is, the platen roller 60 is locked by simple locking.

Figure 11A:
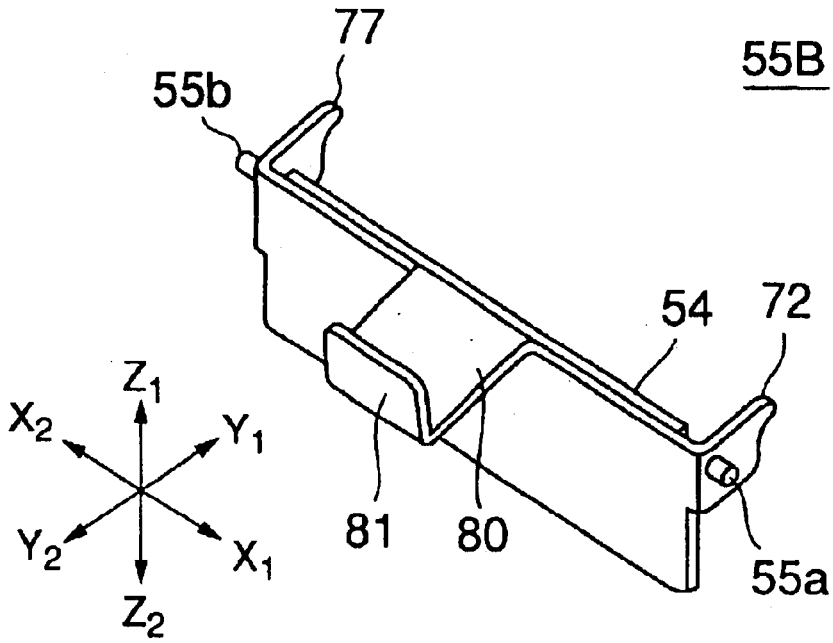
FIGS. 11A and 11B are a perspective view and a side view, respectively, showing a second variation of the thermal head supporting member.
Figure 11B:
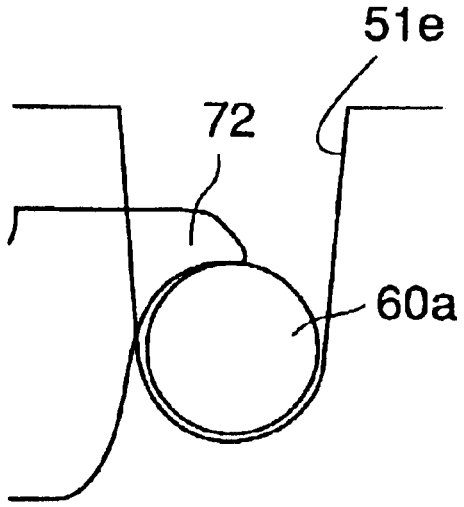

FIGS. 11A and 11B show a thermal head supporting member 55B according to a second variation of the thermal head supporting member 55.

The thermal head supporting member 55B differs from the thermal head supporting member 55 shown in FIGS. 6A, 6B, and 7 in that the thermal head supporting member 55B does not include the lifting parts 73 and 78. The thermal head supporting member 55B includes the lock parts 72 and 77. The lock part 72 locks the shaft part 60*a* as shown in FIG. 11B. The lock part 77 locks the shaft part 60*a* in a similar manner.

Figure 12:
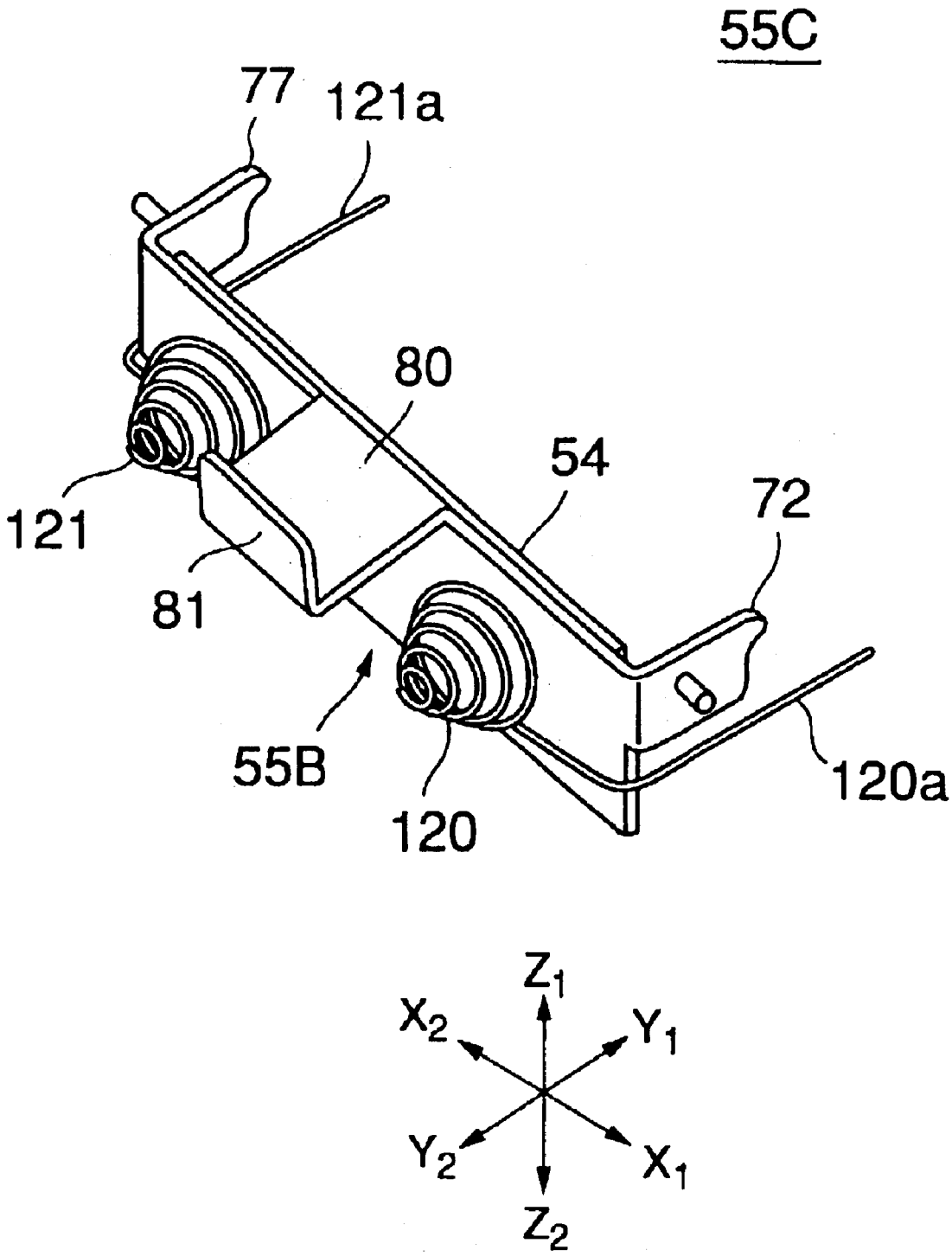
FIG. 12 is a perspective view showing a third variation of the thermal head supporting member.

FIG. 12 shows a thermal head supporting member 55C according to a third embodiment of the thermal head supporting member 55.

The thermal head supporting member 55C is formed such that head pressure biasing coil springs (head pressure biasing spring members) 120 and 121 are fixed to the back surface of the thermal head supporting member 55B shown in FIGS. 11A and 11B. The head pressure biasing coil springs 120 and 121 include wire-like spring portions 120*a* and 121*a* extending in the Y1 direction, respectively. The wire-like spring portions 120*a* and 121*a* possess functions of popping up the shaft parts 60*a* and 60*b*, respectively.

Figure 13A:
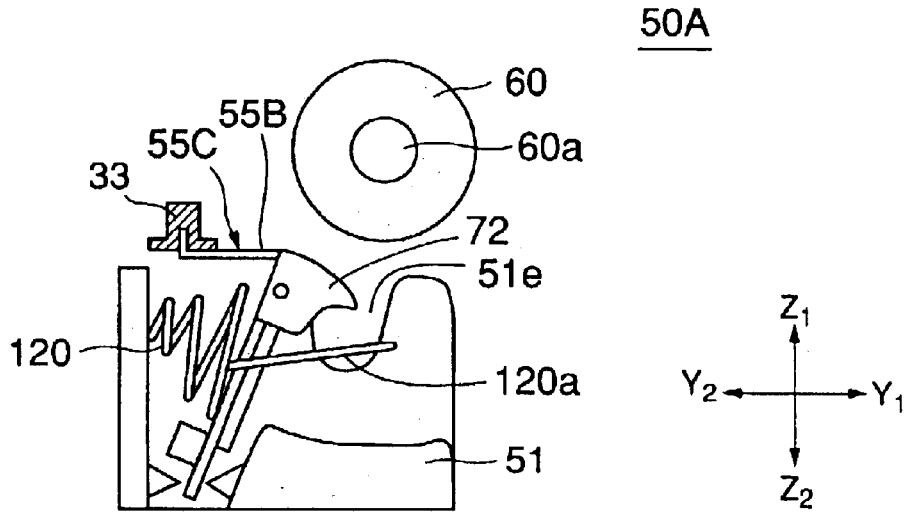
FIGS. 13A, 13B, and 13C are side views showing a thermal printer unit in which the thermal head supporting member shown in FIG. 12 is incorporated.

As is shown in FIG. 13A, the thermal head supporting member 55C is incorporated in a thermal printer unit 50A. The wire-like spring portions 120*a* and 121*a* cross the platen roller receiving part 51*e*.

Figure 13B:
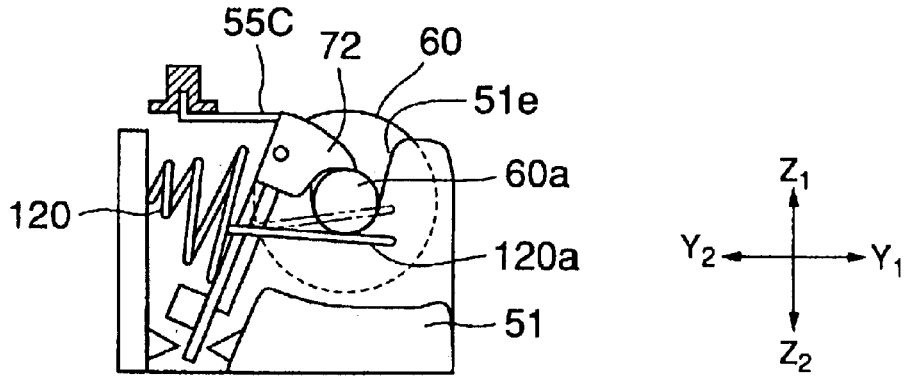
Figure 13C:
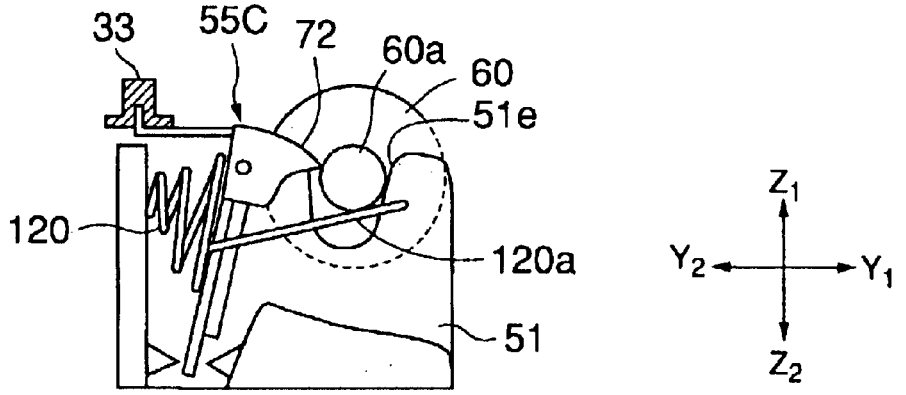

As is shown in FIG. 13B, in the state where the platen roller 60 is locked and fixed, the wire-like spring portion 120*a* is elastically deformed (deflected) in the Z2 direction. When the lock is released as shown in FIG. 13C, the platen roller 60 is popped up by the spring force of the wire-like spring portion 120*a*.

Figure 14:
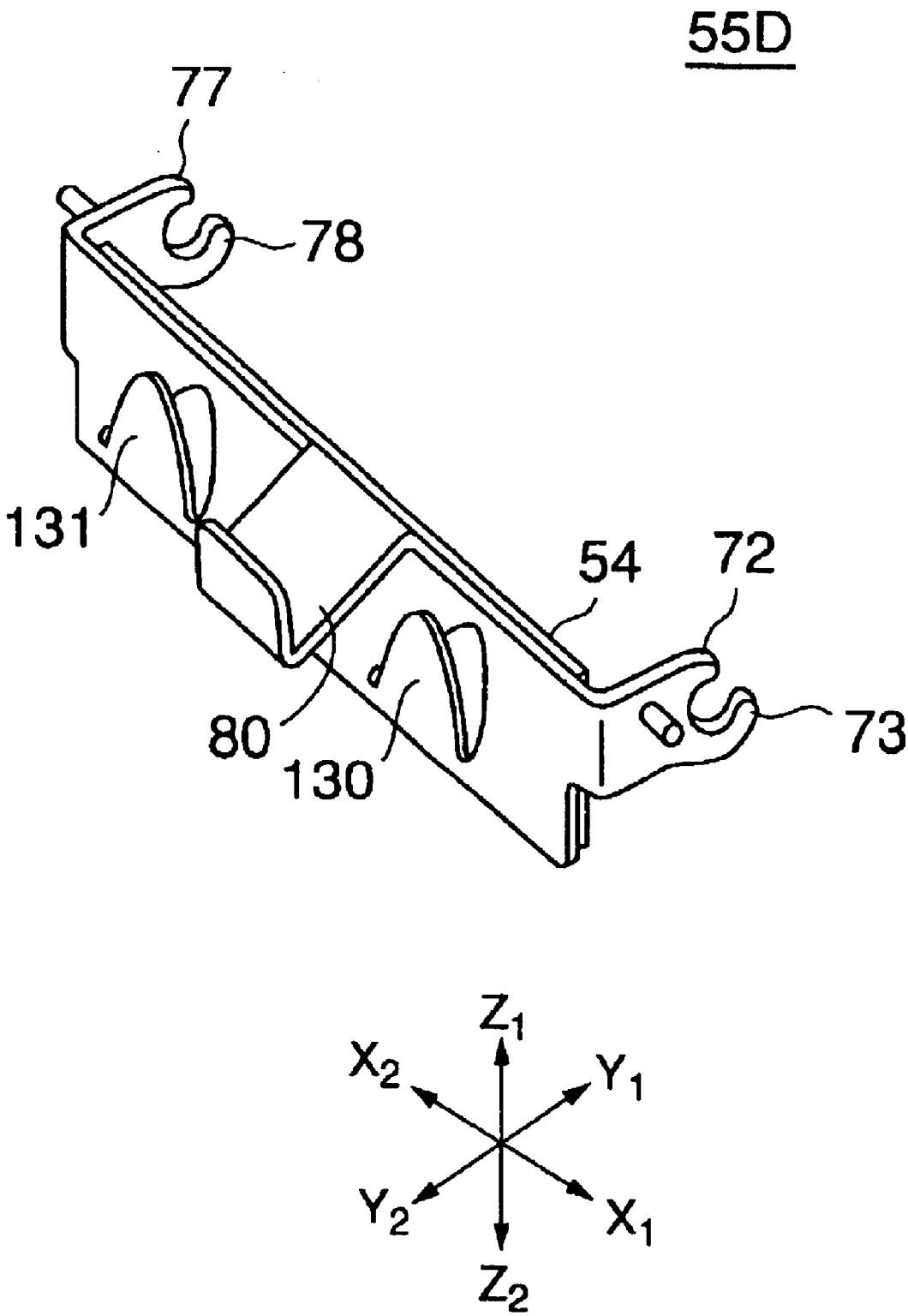
FIG. 14 is a perspective view showing a fourth variation of the thermal head supporting member.

FIG. 14 shows a thermal head supporting member 55D according to a fourth variation of the thermal head supporting member 55.

In the thermal head supporting member 55D, in addition to the lock parts 72 and 77, the lifting parts 73 and 78, and the arm part 80, a pair of leaf spring portions 130 and 131 are formed out of the back surface, as by cutting, and project from the back surface at a non-zero angle relative thereto. The leaf spring portions 130 and 131 bias head pressure. Thus, the spring member 56 in FIG. 3A is not required. Accordingly, the number of components of the thermal printer 40 is further reduced.

Additionally, in order to form the leaf spring portions 130 and 131, the material of the thermal head supporting member 55D preferably is relatively thinner than normal (for example, the material of the aforementioned thermal head supporting members 55, 55A, 55B or 55C). Moreover, since the leaf spring portions 130 and 131 are formed, the area where the thermal head 54 contacts the thermal head supporting member 55D is decreased, resulting in slight degradation of the function of the thermal head supporting member 55D as a heat sink. The degradation of the function as a heat sink, however, does not present a problem in thermal printers that are not used continuously.

The present invention is not limited to the specifically disclosed embodiments, and variations and modifications may be made without departing from the scope of the present invention.

The present application is based on Japanese priority application No. 2002-367091 filed on Dec. 18, 2002, the entire contents of which are hereby incorporated by reference.

What is claimed is:

1. A thermal printer, comprising:

a thermal head;

a platen roller;

a frame having platen roller receiving parts that receive the platen roller in a detachable manner; and a thermal head supporting member to which the thermal head is fixed, the thermal head supporting member being operatively coupled to the frame, the thermal head supporting member having platen roller lock parts that lock the platen roller received by the platen roller receiving parts to resist or prevent the platen roller from exiting the platen roller receiving parts.

2. The thermal printer as claimed in claim 1, wherein the thermal head supporting member has platen roller lifting parts that move the platen roller in a direction in which the platen roller exits the platen roller receiving parts when the thermal head is moved in a direction in which the thermal head is separated from the platen roller.

3. The thermal printer as claimed in claim 1, wherein the thermal head supporting member has an operation part that displaces the thermal head in a direction in which the thermal head is separated from the platen roller.

4. The thermal printer as claimed in claim 1, wherein the thermal head supporting member has a head pressure biasing spring portion that biases head pressure to press the thermal head against the platen roller.

5. The thermal printer as claimed in claim 1, further comprising:

a head pressure biasing spring member pressing the thermal head supporting member to bias head pressure and press the thermal head against the platen roller, the head pressure biasing spring member having a spring portion that is pressed and deflected by the platen roller received in the platen roller receiving parts, and when lock of the platen roller is released, restored to move the platen roller in a direction in which the platen roller exits the platen roller receiving parts.

6. An apparatus, comprising:

a thermal printer comprising a thermal head;

a platen roller;

a cover supporting the platen roller, the cover being rotatably opened and closed;

a frame having platen roller receiving parts that receive the platen roller in a detachable manner, the platen roller being received by the platen roller receiving parts when the cover is closed; and a thermal head supporting member to which the thermal head is fixed, the thermal head supporting member being operatively coupled to the frame, the thermal head supporting member having platen roller lock parts that locks the platen roller received by the platen roller receiving parts to resist or prevent the platen roller from exiting the platen roller receiving parts.

7. A thermal printer, comprising:

a thermal head;

a platen roller;

a frame having platen roller receiving parts that detachably receive the platen roller;

a thermal supporting member to which the thermal head is fixed, the thermal head supporting member being operatively coupled to the frame; and platen roller lock parts integrally formed with the thermal head supporting member, the platen roller contacting the platen roller lock parts and rotating the thermal head supporting member in a direction that moves the platen roller lock parts away from the platen roller receiving part to receive the platen roller in the platen roller receiving parts, and the thermal head supporting member being rotated in an opposite direction after the platen roller is received by the platen roller receiving parts in a direction that moves the platen roller lock parts toward the platen roller receiving parts to lock the platen roller in the platen roller receiving parts.

* * * * *

UNITED STATES PATENT AND TRADEMARK OFFICE

CERTIFICATE OF CORRECTION

PATENT NO. : 6,765,602 B2
APPLICATION NO. : 10/463513
DATED : July 20, 2004
INVENTOR(S) : Yukihiro Mori It is certified that error appears in the above-identified patent and that said Letters Patent is hereby corrected as shown below:

In column 9, line 14, change “locks” to --lock--.

In column 10, line 3, insert --head-- after “thermal”.

Signed and Sealed this

Eighteenth Day of September, 2007

JON W. DUDAS
*Director of the United States Patent and Trademark Office*